United States Patent [19]

Ungar

[11] Patent Number: 4,565,373

[45] Date of Patent: Jan. 21, 1986

[54] NUMERICAL GUESSING GAME

[76] Inventor: Bracha B. Ungar, 230 B Hilltop La., Annapolis, Md. 21403

[21] Appl. No.: 626,220

[22] Filed: Jun. 29, 1984

Related U.S. Application Data

[63] Continuation-in-part of Ser. No. 400,234, Jul. 21, 1982, abandoned.

[51] Int. Cl.[4] ..... A63F 3/00

[52] U.S. Cl. ..... 273/265

[58] Field of Search ..... 273/265, 272, 273, 299, 273/236

[56] References Cited

U.S. PATENT DOCUMENTS

| | | | |
|---|---|---|---|
| 2,205,440 | 6/1940 | Schoenberg | 273/299 |
| 3,126,205 | 3/1964 | Jordan | 273/274 |
| 3,267,590 | 8/1966 | Browning | 273/272 X |
| 4,059,274 | 11/1977 | Samson et al. | 273/130 D |
| 4,188,036 | 2/1980 | Jones-Fenleigh | 273/265 |
| 4,241,923 | 12/1980 | Meirovitz | 273/265 |
| 4,272,081 | 6/1981 | Broom | 273/265 |

FOREIGN PATENT DOCUMENTS

| | | | |
|---|---|---|---|
| 67828 | 10/1975 | Australia | 273/265 |
| 1009675 | 5/1977 | Canada . | |
| 1039325 | 9/1978 | Canada | 273/265 |
| 1541537 | 3/1979 | United Kingdom . | |
| 2034588 | 6/1980 | United Kingdom | 273/265 |

*Primary Examiner*—Richard C. Pinkham
*Assistant Examiner*—Matthew L. Schneider
*Attorney, Agent, or Firm*—Lowe, King, Price & Becker

[57] ABSTRACT

A deductive numerical game played by plural (N) players, one of whom is a dealer, includes N sets of first game pieces, each set including a like plurality (M) of game pieces respectively bearing indicia representing consecutive numbers. A second set of game pieces respectively bear indicia representing different cumulative totals equal to the sum of the numbers displayed on J (J is less than M) first game pieces to be selected from the first game piece set of the dealer. The J first game piece set of the dealer defines a match set hidden by the dealer from each other player's view. The dealer selects and displays a second set game piece to inform each player of the cumulative total equal to the sum of hidden indicia displayed within the match set. Each player in turn selects J first game pieces with indicia having a total corresponding to the dealer's second set game pieces cumulative value. The dealer informs each player in turn as to the number of first game pieces correctly selected by the player which corresponds to first game pieces within the match set. One of the players thus reduces the exact combination of first game pieces forming the dealer's match set. One of a third set of game pieces shown by the dealer to all players bears a number corresponding to the number of first game pieces correctly selected by each player.

3 Claims, 8 Drawing Figures

1 4 PTS
2 3 PTS
3 2 PTS
4 1 PT
114
111
101
104
102
105
106
107
103
INPUT
FEED BACK
MEMORY BANK
113
112

NUMERICAL GUESSING GAME

RELATIONSHIP TO COPENDING APPLICATION

The present application is a continuation-in-part of application Ser. No. 400,234, filed July 21, 1982, entitled "Numerical Game" and now abandoned.

TECHNICAL FIELD

The present invention relates generally to logical deduction games, and more particularly to numerical games requiring knowledge of arithmetic by a player to determine a set of numbers with clues supplied by an opponent.

BACKGROUND ART

One type of logical deduction game requires a player to deduce a particular arrangement of game pieces selected by an opponent with provided clues. One currently popular logical game, MASTERMIND, described in Canadian Pat. No. 1,009,675, includes sets of pegs having different colors. A predetermined number of these pegs are arranged in a sequence on a pegboard by one player. A second player who is unable to see the pegs of the first player attempts to deduce the colors and sequence of the pegs in response to clues from the first player. Each clue follows each turn of the second player. Each turn requires the second player to display different colored pegs in a successive row of the pegboard. After each turn, the first player provides the second player with clues in the form of black and white pegs; a black peg informs the second player that one of the selected pegs is correct in color and pegboard position while a white peg informs that a correctly colored peg only has been chosen (i.e. not placed by the second player in a pegboard hole corresponding to the location of the first player's correspondingly colored peg). The first player's object is to determine the opponent's peg arrangement in the least number of turns with these clues. To my knowledge, only one player can play against an opponent, thus precluding others from participating. Also the game is limited to deduction of colors, although a variance of the game utilizing letters to form words is known.

Another numerical game, disclosed in British Pat. No. 1,541,537, includes several game cards, having sixteen numbers printed in a four-by-four matrix so the sum of the numbers is '34' in each of the horizontal, vertical and diagonal directions. The game cards are not identical since either different numbers are used to obtain the sum of '34' or the same number appearing in more than one game card may appear in a different row or column in different game cards. One of the players who is a dealer selects one of the game cards and hides it from the view of the other player. The object of the game is for the other player to determine the correct location of the game card numbers with clues supplied by throwing three dice and having the dealer position a numbered peg corresponding to the sum of the three dice in a peg hole on a four-by-four pegboard corresponding to the location of the number on the game card. If the player can guess the correct location of all the game card numbers within eight throws of the dice, the dealer loses.

The game disclosed in the British '537 patent is challenging and somewhat educational, since it requires the player to have both sufficient knowledge of arithmetic and deductive abilities to deduce the missing numbers not revealed by the thrown dice, by subtracting the numbers revealed by the dice from the known cumulative total of the game card. However, since dice are required to initially generate up to eight of the sixteen game board numbers, these numbers are obtained by random selection, requiring no player skill. The game is also limited to play by one player, thus precluding use of this game as a group activity. Further, to my knowledge, since the game is played only with preprinted game cards, as described above, the level of difficulty involved in playing the game cannot be varied.

A numerical game testing both arithmetic and deductive abilities should be fun and challenging to adult players. More importantly, a numerical game can be a useful educational tool for teaching children basic arithmetic (e.g. addition and subtraction) operations and to aid in proper development of deductive abilities. To accomodate players of different skill, the level of difficulty during play is preferably changeable so that the game can be both challenging and educational to players of many skill levels. Finally, a numerical game is desirably capable of play as a group activity, to provide a sense of competitive awareness and to allow plural players to participate.

SUMMARY OF THE INVENTION

It is accordingly one object of the present invention to provide a new and improved numerical deductive game that can be played by plural players, including a dealer.

Another object is to provide a new and improved numerical deductive game for testing arithmetic knowledge and improving deductive abilities of players at many skill levels.

Still another object is to provide a new and improved numerical deductive game that is easily adjusted to various skill levels, both prior to and during play.

Yet another object is to provide a new and improved numerical deductive game that is challenging and enjoyable to players of all ages.

Yet a further object is to provide a new and improved numerical deductive game that can be used as an educational aid for teaching basic arithmetic.

In accordance with the present invention, a deductive numerical game that is played by two or more (i.e. N) players, one of whom is a dealer, includes N sets of first game pieces, one for each of the players and the dealer and a second set of game pieces for the dealer. Each of the N sets includes a like plurality (M) of game pieces; the M pieces have indicia representing consecutive numbers. The game pieces of the second set have indicia representing different cumulative totals equal to the sum of the numbers displayed on J (where $J<M$) of the first game pieces. The J first game pieces are selected by the dealer from the dealer's first game piece set to define a match set hidden from the view of the other players. The dealer selects and displays a game piece of the second set to inform the other players of the cumulative total of numbers in the match set. Each other player in turn then selects J of his game pieces having a cumulative value equal to the value displayed on the second set game piece. The dealer then informs each other player in turn of the number of selected game pieces having indicia corresponding to the indicia of the game pieces in the match set.

The first and second sets of game pieces challenge the players to deduce the exact permutation of first game pieces in the match set. By varying the number (M) of first game pieces or the number (J) of match set pieces, the skill level required to play the numerical game of the invention is changed.

Preferably the game pieces of the first set are tiles separately supported in an upright position position before each player, including the dealer, on a ledge of a rack. A second rack for the dealer stores the first set game pieces forming the match set.

Game pieces of a third set include indicia representing consecutive numbers, having a maximum value of (J-2). The third set game pieces are used by the dealer to identify the number of first game pieces correctly selected by each other player having indicia corresponding to indicia on game pieces in the match set. The clues provided by the third set game pieces enable the players to deduce the indicia on game pieces in the match set.

To prevent the game pieces of the first, second and third sets from becoming confused with each other, the game pieces of each set have different shapes.

Each player, other than the dealer, is provided with a game board on which the player positions and displays his selected J game pieces. Each game board includes a matrix display having a predetermined number of matrix rows and J columns where the player places his J game pieces during successive rounds of play.

According to the invention, the method of playing the game can also be varied to accomodate players of different skill levels in the following manner. If none of the players has identified the match set after one round of play, the dealer removes a match set game piece none of the players selected. The removed match set piece is shown to the players; thereafter, the dealer selects two additional game pieces from his first set and shows an additional second game piece with the new cumulative total of the match set to the players. This feature allows the dealer to vary, during play, the skill level required to complete the numerical game by perceiving the skill level of each other player during the first round of play, thereby maintaining its challenging nature.

In accordance with the preferred embodiment of the invention, a mathematical game of skill and chance to be played by up to N players, where N is an integer greater than 1, includes N sets of data base tiles. Each of the data base tile sets includes M tiles, with numerical indicia numbered consecutively from one to M. There are provided (N−1) sets of feedback tiles, each including K tiles with numerical indicia numbered consecutively from 0 to (K−1). A set of total number tiles includes P tiles with numerical indicia numbered consecutively from Q to (P+Q). Each of the tile sets, except the feedback set, has a distinctive visual characteristic identifying it uniquely from the other sets. All of the feedback tiles have the same configuration which differs from the remaining sets. The game is played with a board having a central designated area for receiving one of the total number tiles and N player location areas. Each player location area includes first, second and third designated areas. The first designated area receives the N tiles of one of the sets of data base tiles. The second designated area receives J out of the M data base tiles in one of the sets of data base tiles. The third designated area receives one of the feedback tiles in one of the sets of feedback tiles. The relationship between the number of total tiles, P, the minimum value on the total number tiles, Q, the number of data base tiles in each set, M, and J the maximum number of data base tiles that can go into the second designated area is:

$$P + Q = \sum_{M-J+1}^{M} n$$

In the preferred embodiment, the game is played by up to four players, whereby N=4. In such a situation, the game board is configured to have four sides, one for each player. Each playing area is a part of the game board along the side for that particular player and an area extending from the side for that player toward the center of the board.

In the preferred embodiment, a set of "round" indicating tiles is provided. The round indicating tiles are consecutively numbered from one to S, wherein S is equal to at least 4.

In play, one of the players is designated a programmer who decides which total number tile is to be put into the central designated area and who selects the data base tiles of his set of data base tiles having indicia which add up to the value of the indicium on the total number tile put in the center designated area. The programmer places the selected tiles face down in his second designated area. The remaining players move R of their data base tiles from their first designated area so the R data base tiles are face up in the second designated area for each player. The value of R is anywhere from 2 to J. The programmer then places in each third designated area a feedback tile having indicium commensurate with the number of tiles that the player at the particular location has that match the indicia of the data tiles selected by the programmer. Prior to the remaining players, i.e., the players who are not the programmer, selecting and displaying the initial data base tiles to be put into the second designated area, the programmer displays a round indicating token having an indication of a first round. If none of the remaining players correctly matched his data base tiles with the programmer's data base tiles, the game proceeds to the second round. After the first round has been completed and prior to the second round starting, the programmer displays a tile indicating the second round is in progress. In the second round, the remaining players select from their M data base tiles the tiles which they feel match the concealed data base tiles of the programmer and place the then selected tiles in the second designated area. The game proceeds in this manner for P rounds. Points are awarded based on the round in which the remaining player(s) selects his data base tiles which match completely those of the programmer. If none of the remaining players has achieved a match after S rounds, the programmer is awarded a maximum number of points.

BEST MODE FOR CARRYING OUT THE INVENTION

Figure 2:
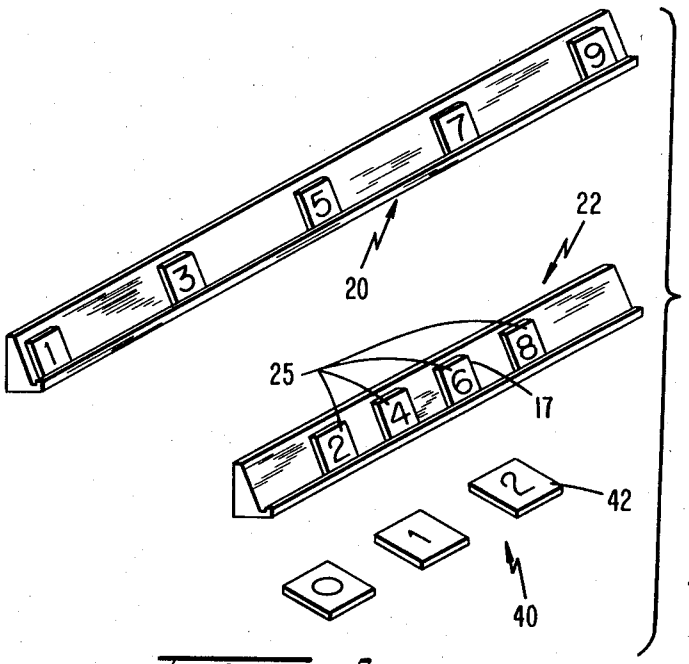
FIG. 2 is a perspective view of the game pieces of the first set on a rack, in combination with a match set on a second rack, and the third set of game pieces.
Figure 3:
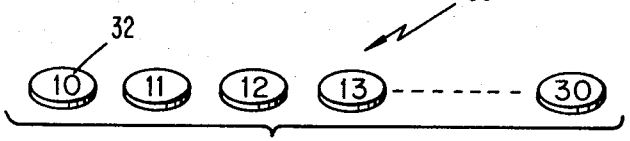
FIG. 3 is a perspective view of all pieces in the second set.
Figure 1:
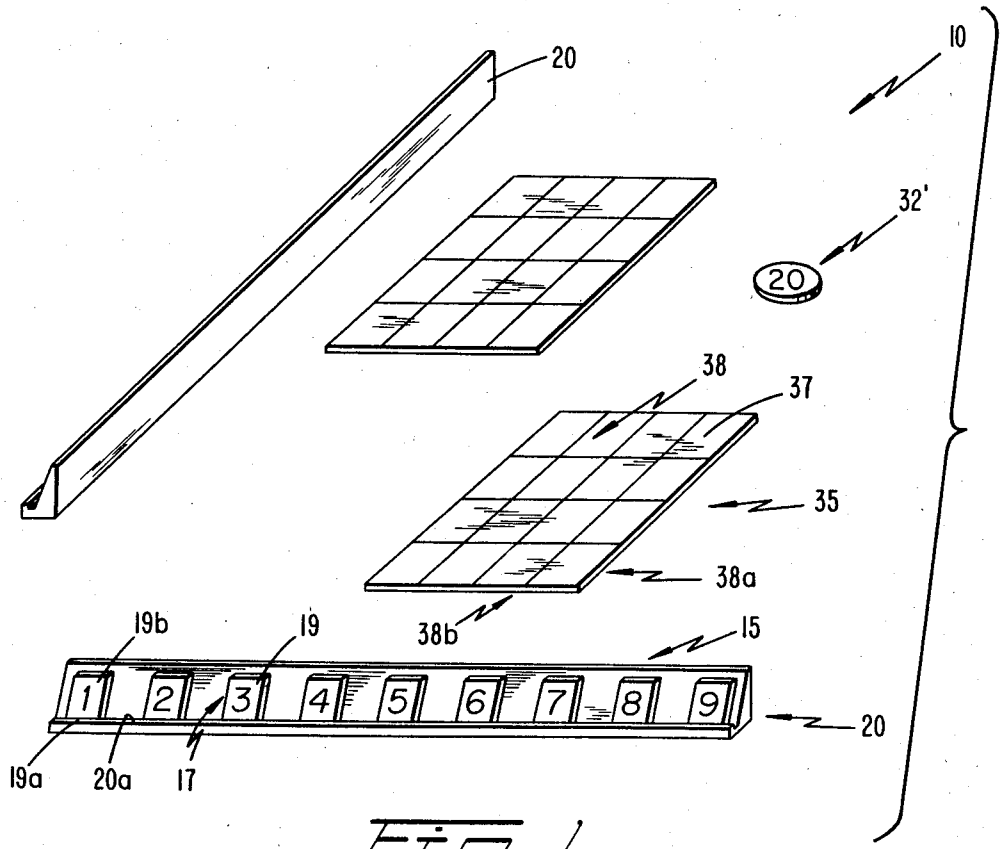
FIG. 1 is a perspective view of supporting racks and game boards of two players, other than the dealer, in combination with the game pieces of the first set of one player and a game piece of the second set.

Referring to FIG. 1, deductive numerical game 10, is to be played by plural (N) players, one of whom is a dealer. Each player, other than the dealer, is provided with a first set of M rectangular, numeral bearing game pieces 17, rack 20 and playing board 35. Consecutive numerals are on game pieces 17 for each player. As illustrated in FIGS. 2 and 3, the dealer is provided with a first set of M pieces 17, first and second racks 20 and 22, a second set of circular numeral bearing game pieces 30 and a third set of rectangular numeral bearing pieces 40 which are larger than pieces 17 so the pieces of the three sets can be easily distinguished. The dealer selects J pieces 17 that he puts on rack 22 to form a match set. J is preferably a median number of M, e.g. M/2 (for M being even) or $M \pm 1/2$ (for M being odd). The pieces of set 30 are consecutively numbered from $S_1$ to $S_2$ with the possible sums of the combination of pieces of the match set. The pieces of set 40 bear the consecutive numbers 0 to J-2 to indicate the number of pieces a particular player selects from his rack 20 which correspond with the indicia in the match set.

In the illustrated embodiment, there are two players, other than the dealer, and there are nine first game pieces 17 containing the consecutive numbers '1', '2', through '9', whereby $N=3$ and $M=9$, $J=4$, $S_1=10$, and $S_2=30$; the numbers on the pieces of set 40 are 0, 1 and 2. It is to be understood that N and M can differ and/or different consecutive number series can be provided on game pieces 17, with resulting changes to the numbers on the pieces of sets 30 and 40 and to the number of pieces in sets 30 and 40.

Each game piece 17 is preferably a rectangular tile 19 having a straight lower edge **19*a* placed by a player on lower supporting ledge 20*a* of rack 20. Rack 20 supports game pieces 17 in each set 15 in a generally upright position so that a numeral bearing flat surface 19*b* on each tile 19** faces the player.

The object of the game is for each player to deduce the exact numbers displayed on the J first game pieces 17 selected by the dealer, prior to the start of play by the other players to form the match set 25. Pieces 17 selected to form set 25 are positioned by the dealer on rack 22 so the numbers on the pieces of the match set face only the dealer. To begin play, the dealer selects and shows the other players the number on the appropriate second set game piece 32' (see FIG. 1).

In the drawing, the four first game pieces 17 of match set 25 bear numerals '2', '4', '6' and '8', totalling '20', whereby the dealer shows second set game piece 32' bearing the numeral '20' to the other players. The game begins with the players, other than the dealer, having knowledge only of the quantity (J) of first game pieces 17 forming match set 25 and the cumulative total thereof displayed on second set game piece 32'.

One rectangular game board 35 is distributed to each player other than the dealer. Each game board 35 includes a flat playing surface 37 bearing lines forming a matrix 38 having a predetermined number of rows **38*a* and J columns 38*b*. During each round of play, each player, in turn selects and puts J first game pieces 17 in the J matrix columns 38*b* respectively of one matrix row 38*a***.

Figure 4A:
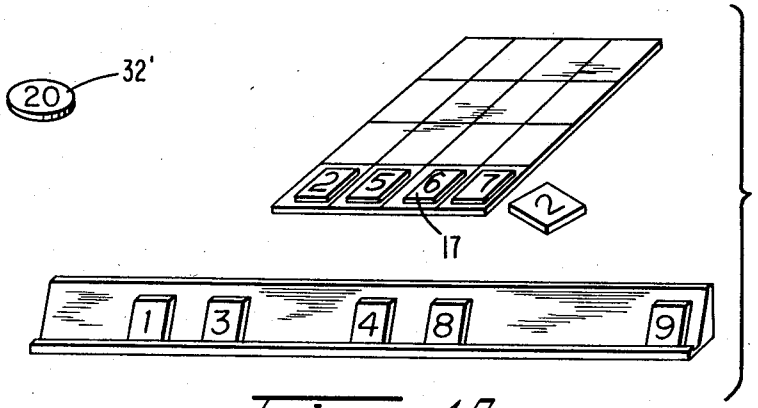
FIGS. 4A and 4B are perspective views of the racks, game piece tiles and playing boards of two players, other than the dealer, during a first round of play.
Figure 4B:
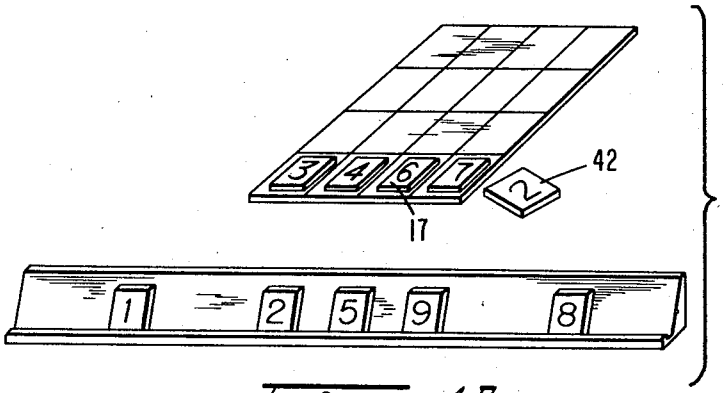

FIGS. 4A and 4B are respectively illustrations, during a first round of play, of the racks, tiles and playing boards for first and second players, other than the dealer, for the dealer situation illustrated in FIGS. 1 and 2. In the first round of play, the first player (FIG. 4A) has selected from first set 15 and put on game board 35 four tiles 19 respectively bearing numerals '2', '5', '6' and '7', totalling '20', the number of piece 32. Since the first player has correctly identified two first set game pieces 17 in match set 25 (i.e. '2' and '6'), the dealer selects piece 42 bearing the numeral '2'. All the players are now informed that two of the first player's selected pieces 17 are in match set 25.

FIG. 4B is an illustration of the second player's move during the first round of play after the turn of the first player. The second player realizes that two of the first player's pieces 17 displayed on game board 35 are in match set 25. For exemplary purposes, the second player believes that the first player correctly guesed that numerals '6' and '7' are in match set 25; therefore, the second player now puts on game board 35 four pieces 17 bearing numerals '3', '4', '6' and '7' (totalling '20'). Because two of pieces 17 have been correctly selected by the second player (i.e. '4' and '6'), the dealer shows a third set game piece 42 bearing numeral '2' to the players.

Figure 5A:
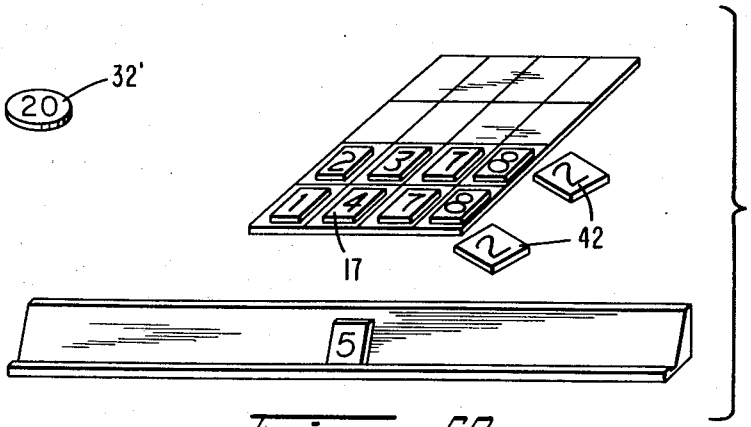
FIGS. 5A and 5B are perspective views of the racks, game piece tiles and playing boards of the same two players during a second round of play.
Figure 5B:
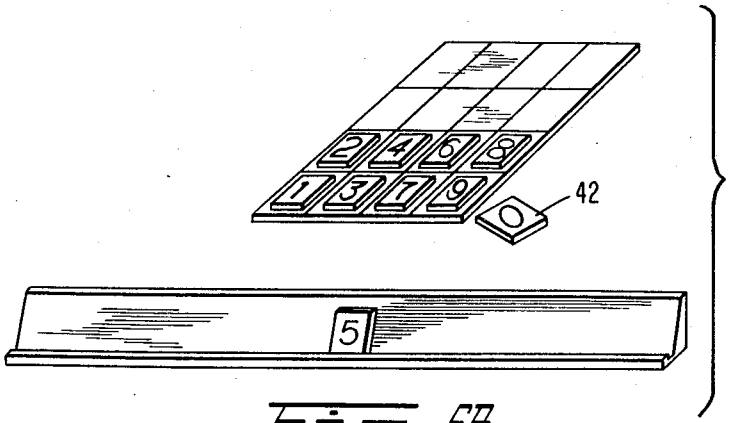

FIG. 5A is an illustration of the rack, tiles and board of the first player during the second round of play. In the second round of play, the first player selects four pieces 17 respectively bearing numerals '2', '3', '7' and '8', totalling '20'. Since only two pieces 17 are correctly selected by the first player, the dealer shows the game piece 42 bearing the numeral '2' to the players. Since only a limited combination of four (J) first game pieces 17 can be selected from M game pieces forming the first set 15, the second player can now correctly deduce, without guessing, set 25 from the known clues, described above, in the second round of play (see FIG. 5B). If the second player correctly deduces the correct combination of the match set 25, he becomes the winner and can become the dealer.

The skill level of the game can be initially controlled by starting the game with a predetermined number (M) of first game pieces 17 forming first sets 15, and then adjusting the number (J) of first game pieces in match set 25 so that J and M are selected to maximize the permutations of first game pieces (J) that can be added together to arrive at the same cumulative total. For example, by selecting fewer (J) pieces 17 in relation to (M) pieces forming first sets 15 to form set 25, game 10 becomes easier to play.

According to a further aspect of the invention, the skill level can also be adjusted by the dealer during play. For example, if none of the players correctly guess matched set 25 during the first round of play but have correctly guessed some or most of first pieces 17 forming match set 25, thereby exhibiting a relatively high level of skill, the dealer can remove one of the matched set pieces not selected by any of the players. The piece 17 removed from match set 25 is shown to the players; thereafter, two additional first set pieces 17 are selected from dealer's first set 15 for inclusion in the match set, thereby increasing the match set to J+1 pieces. An additional, second set game piece 32' showing the new cumulative total of match set 25 is now shown to all players, whereby subsequent rounds of play require greater skill by the players, since the number of pieces in match set 25 has increased.

It is to be understood that the invention is capable of changes or modifications within the scope of the invention concept as expressed herein. For example, in addition to allowing each player to correctly deduce the match set to become the winner, a predetermined number of points can be awarded to each player, depending upon the number of pieces 17 correctly selected during play. Further, during subsequent rounds of play, different numbers of pieces 17 can be removed and added to match set 25 in accordance with the variation described above.

Figure 6:
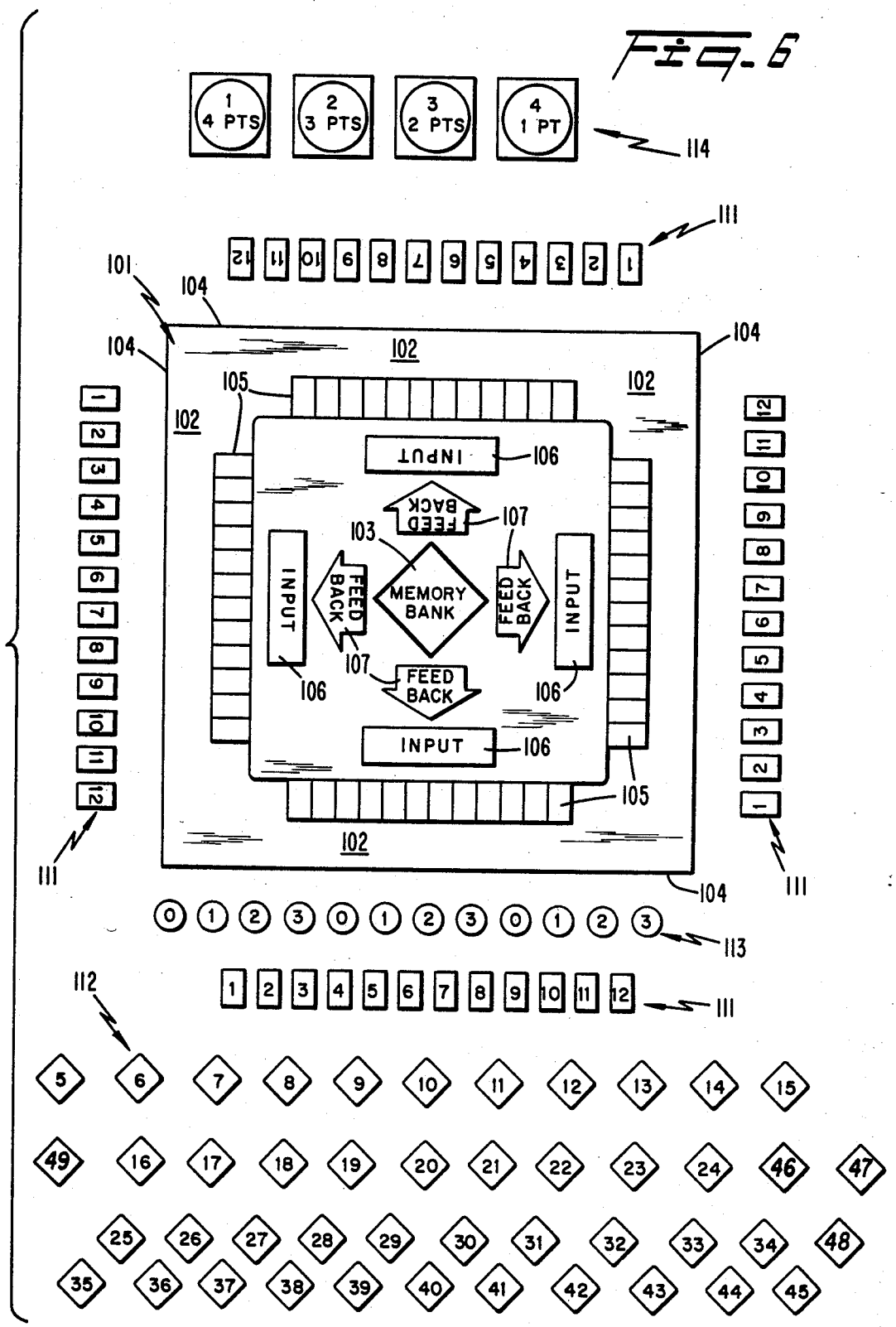
FIG. 6 is a view of an embodiment of the invention incorporating a game board and numerous different sets of tiles.

Reference is now made to FIG. 6, wherein there is illustrated an embodiment of the invention including square game board 101, including four player areas 102 and a central designated area 103. Each of player areas 102 includes first rectangular designated area 105, second rectangular designated area 106, and an arrow shaped designated area 107. Each of designated areas 105 and 106 extends in a direction parallel to edge 104 for a particular player area. Designated area 107 is shaped as an arrow pointing outwardly from central, diamond shaped designated area 103 toward edge 104 of each particular player area. Central designated area 103 includes the indicia "memory bank", while designated areas 106 and 107 respectively include the indicia "input" and "feedback".

Game board 101 is played with up to four (N=4) sets of rectangular data base tiles, each having a rectangular shape and the same size. One set of data base tiles is provided for each player, with each set being distinguishable from the other because they have different colors. Each of the data base tile sets includes identical indicia in the form of consecutive numerals, beginning with the integer 1. In the preferred embodiment, each of data base tile sets 111 includes 12 tiles, consecutively numbered from 1 to 12. Each of designated areas 105 has a height equal to the height of each of the data base tiles 111 and a length sufficient to accept all twelve tiles of each data base set. Each of areas may be ruled from top to bottom to designate the area into which each separate data base tile is to be placed. Designated areas 106 have sufficient length to accomodate five tiles (J=5) and a height equal approximately to the height of each tile.

The game is provided with a set of 45 (M=45) diamond shape total tiles, each having the same area and shape. Total tiles 112 are consecutively numbered from 5 to 49 to enable the game to be played on many different levels and by as few as two and as by as many four persons. Forty-nine is selected as the maximum number on the set of total tiles because a total of five tiles can be placed in designated areas 106. The maximum sum which one of the players, designated as a programmer, can select for a 12 data tile situation, without considering the obvious solution of 50, is 49 because 12+11+10+9+8=50.

Three sets of "feedback" tokens or tiles 113 are provided. One set of feedback tokens 113 is provided for each of the remaining players, i.e., the players who are not the programmer. Each set of feedback tokens, which are circular and have the same diameter, bears the indicia 0, 1, 2 and 3. The programmer places the feedback tokens, as appropriate, in feedback designated areas 107 to indicate to each of the remaining players the number of tiles in the remaining players' second designated area 106 which match the data tiles which the dealer has placed face down in his second designated area 106.

There is also provided for the dealer a set of relatively large "round" indicating tokens 114, having a square shape. Four such round indicating tokens are provided, bearing the indicia 1, 2, 3 and 4 in relatively large letters within a circle. In smaller lettering below the numerals 1–4 are respectively indicated "four points", "three points", "two points", and "one point". Prior to the game being started the programmer displays the round indicating token of set 114 which bears the indicia 1 and "four points". If there is no match between the remaining players and the programmer during the first round, the dealer substitutes the token of set 114 which bears the indicia "2" and "3 points"; for subsequent rounds, the dealer performs in a like manner.

To play the game illustrated in FIG. 6, the programmer initially selects his data base tiles from set 111 and the appropriate total tile from set 112, and displays the round marker of set 114 bearing the indicia "1" and "four points". The programmer places the selected data base tiles face down in his designated area 106 and places the selected total tile of set 112 face up into central area 103. Then, each remaining player selects from the data base tiles which he has assembled in area 105 the five data base tiles which he believes matches the five data base tiles which the programmer has placed face down in the programmer's designated area 106. Each of the remaining players places his selected tiles face up in his area 106. The programmer then selects the feedback token from set 113 that is appropriate for each remaining player and places that feedback token in the feedback designated area 107 for the respective player. The programmer places into each of the remaining players' feedback areas 107 a tile from set 113 which is equal to the number of displayed tokens in area 106 of that particular player which matches the number of data tiles which are concealed in the programmer's area 106. Thereby, astute players will, after the first round, be able to make more highly educated appraisals of the correct numbers to be placed in designated areas 106 the next time around. Prior to the players changing their tiles from areas 105 to areas 106, the programmer replaces round indicating marker with indicia "1" and "four points", with the round indicating marker containing the indicia "2" and "three points", provided no one has correctly matched the programmer's concealed data base tiles in the first round. The game proceeds for four rounds. If no one has made a correct match after four rounds, the programmer is awarded four points. If a correct match is made prior to four rounds being completed, the person or persons who achieved the correct match receive points according to the displayed round marker. After one game has been concluded, the job of programmer shifts to another person around the table, in clockwise or counterclockwise order. The points from several games are accumulated and the winner is determined at an appropriate time, which can be determined by the number of games played or by any lapsed time.

In this disclosure, there are shown and described only the preferred embodiments of the invention, but, as aforementioned, it is to be understood that the invention is capable of use in various other combinations and environments and is capable of changes or modifications within the scope of the invention concept as expressed herein.

I claim:

1. A mathematical game of skill and chance to be played by up to N players, where N is an integer greater than one, comprising:

(a) N sets of data base tiles, each of said data base tile sets including M tiles with numerical indicia numbered consecutively from 1 to M;

(b) (N−1) sets of feedback tiles, each of said feedback tile sets including K tiles with numerical indicia numbered consecutively from 0 to (K−1);

(c) a set of total number tiles including P tiles with numerical indicia numbered consecutively from Q to (P+Q−1);

(d) each of said tile sets having a distinctive visual characteristic identifying it uniquely from the other sets; and (e) a playing board having: a central designated area having indicia corresponding with the total number tiles for receiving one of the total number tiles, and N player location areas;

each player location area including: a first designated area related to the M tiles of one of the sets of data base tiles and having a size, shape and indicia corresponding with the M tiles of one of the sets of data base tiles for receiving the M tiles of one of the sets of data base tiles, a second designated area related to J out of the M data base tiles in one of the sets of data base tiles and having a size, shape and indicia corresponding with the J tiles in one of the sets of data base tiles for receiving the J tiles in one of the sets of data base tiles, and a third designated area having indicia corresponding with the feedback tiles for receiving one of the feedback tiles in one of the sets of feedback tiles;

$$\text{where } P + Q = \sum_{M-J+1}^{M} n$$

said first, second and third areas including indicia rendering them distinctive from each other.

2. The game of claim 1 wherein N=4, the game board having four sides, one for each player, each player area being a part of the game board along the side for that player and an area extending from the side for that player toward the board center.

3. The game of claim 1 further including a set of round indicating tiles consecutively numbered from 1 to S, wherein S is equal to at least 4, whereby one of the players is designated a programmer who decides which total number tile is to be put in the central designated area and who selects the data base tiles of his set of data tiles having indicia which add up to the value of the indicium on the total number tile put in the central designated area and who places the selected tiles face down in his second designated area, the remaining players move R of their data base tiles from their first designated area so they are face up in their second designated area, where R is from 2 to J, the programmer places in each third designated area a feedback tile having indicium commensurate with the number of tiles of the player at the particular location having indicia that match the indicia of the turned over data tiles in the programmer's second designated area, the programmer initially displaying a round indicating tile having an indication of value for a first round, the programmer displaying a round indicating tile having a consecutively increasing value after each time that none of the remaining players has all of the matching data tiles in the second designated areas.

* * * * *